US007984630B2

(12) United States Patent
Peot et al.

(10) Patent No.: US 7,984,630 B2
(45) Date of Patent: Jul. 26, 2011

(54) LOCKER LOCK

(76) Inventors: Paul R. Peot, Mequon, WI (US); Glenn P. Meekma, Menomonee Falls, WI (US); Karthick Babu, Chennai (IN); Ajay Jayaraman, Chennai (IN)

( * ) Notice: Subject to any disclaimer, the term of this patent is extended or adjusted under 35 U.S.C. 154(b) by 725 days.

(21) Appl. No.: 11/774,038

(22) Filed: Jul. 6, 2007

(65) Prior Publication Data

US 2008/0209962 A1 Sep. 4, 2008

Related U.S. Application Data

(60) Provisional application No. 60/904,243, filed on Mar. 1, 2007.

(51) Int. Cl.
*E05B 65/06* (2006.01)
*E05B 13/10* (2006.01)

(52) U.S. Cl. ..... 70/135; 70/210; 292/210; 292/213

(58) Field of Classification Search ..... 70/137, 70/284, 285, 314–316, 135, 136, 138, 150, 70/210; 292/163, DIG. 68, 145, 150, 169, 292/175, 207, 210, 213, 214, 218, 341.15, 292/194, 229, 232, 234, 238, 240–242
See application file for complete search history.

(56) References Cited

U.S. PATENT DOCUMENTS

| | | | | |
|---|---|---|---|---|
| 13,722 | A | 10/1855 | Holmes | |
| 214,251 | A | 4/1879 | Hamm | |
| 257,725 | A * | 5/1882 | Lalor | 70/141 |
| 307,281 | A | 10/1884 | Farrar | |
| 558,547 | A | 4/1896 | Burrows | |
| 781,185 | A * | 1/1905 | Campbell | 292/213 |
| 885,559 | A | 4/1908 | Woodward | |
| 900,437 | A * | 10/1908 | Soley | 70/309 |
| 900,438 | A | 10/1908 | Soley | |
| 925,900 | A | 6/1909 | Hansen | |
| 930,534 | A * | 8/1909 | Cox | 292/78 |
| 1,036,348 | A | 8/1912 | Schmittberger | |
| 1,466,489 | A * | 8/1923 | Starrett | 70/135 |
| 1,592,406 | A | 7/1926 | Worley, Jr. | |

(Continued)

FOREIGN PATENT DOCUMENTS

DE 2342574 3/1975

(Continued)

OTHER PUBLICATIONS

International Search Report for PCT/US07/15957, dated Jan. 1, 2008.

(Continued)

*Primary Examiner* — Carlos Lugo
*Assistant Examiner* — Alyson M Merlino

(57) ABSTRACT

A lock includes a lock housing, a lock interface, a rotary locking member, a locking bolt, and a locking mechanism. The rotary locking member extends from a side portion of the lock housing, the rotary locking member being rotatable about a first axis between a locking position and a releasing position. The locking bolt is configured to hold the rotary locking element in the locking position when the locking bolt is in a first position and to allow the rotary locking member to rotate from the locking position to the releasing position when the locking bolt is in a second position. The locking mechanism is configured to slide the locking bolt from the first position to the second position in response to proper manipulation of the lock interface.

34 Claims, 9 Drawing Sheets

U.S. PATENT DOCUMENTS

| | | | | | |
|---|---|---|---|---|---|
| 1,716,169 | A | | 6/1929 | Hart | |
| 1,902,547 | A | * | 3/1933 | Endter | 292/213 |
| 2,002,453 | A | * | 5/1935 | North | 70/285 |
| 2,047,795 | A | | 7/1936 | North | |
| 2,112,982 | A | | 4/1938 | Brauning | |
| 2,156,874 | A | * | 5/1939 | Schonitzer | 292/216 |
| 2,217,098 | A | | 10/1940 | Browne | |
| 2,634,147 | A | | 4/1953 | Robertson | |
| 2,725,739 | A | * | 12/1955 | Check | 70/285 |
| 2,795,947 | A | | 6/1957 | Peras | |
| 2,910,859 | A | | 11/1959 | Allen | |
| 3,190,089 | A | | 6/1965 | Foote et al. | |
| 3,325,203 | A | * | 6/1967 | Moler | 292/201 |
| 3,429,153 | A | | 2/1969 | Magyar | |
| 3,447,348 | A | | 6/1969 | Dauenbaugh | |
| 3,451,704 | A | | 6/1969 | Cothron | |
| 3,691,799 | A | * | 9/1972 | Hoffmann et al. | 70/84 |
| 3,799,594 | A | * | 3/1974 | Watermann | 292/213 |
| 3,890,813 | A | * | 6/1975 | Cothron | 70/92 |
| 3,917,330 | A | | 11/1975 | Quantz | |
| 4,125,008 | A | * | 11/1978 | Genest et al. | 70/278.2 |
| 4,194,377 | A | | 3/1980 | Maeda | |
| 4,281,525 | A | * | 8/1981 | Bako | 70/71 |
| 4,414,828 | A | | 11/1983 | Takinami et al. | |
| 4,438,964 | A | * | 3/1984 | Peters | 292/216 |
| 4,528,829 | A | * | 7/1985 | Bert et al. | 70/389 |
| 4,635,454 | A | | 1/1987 | Brown | |
| 4,648,253 | A | * | 3/1987 | Imhoff | 70/135 |
| 4,682,483 | A | | 7/1987 | Werner | |
| 4,706,478 | A | | 11/1987 | Swan et al. | |
| 4,770,013 | A | | 9/1988 | Nakai | |
| 4,838,054 | A | | 6/1989 | Weinerman et al. | |
| 5,473,922 | A | * | 12/1995 | Bair et al. | 70/416 |
| 5,611,224 | A | | 3/1997 | Weinerman et al. | |
| 6,401,505 | B1 | * | 6/2002 | Kajuch et al. | 70/301 |
| 6,460,708 | B2 | * | 10/2002 | Dean et al. | 211/20 |
| 6,622,534 | B1 | * | 9/2003 | Miller et al. | 70/92 |
| 6,685,242 | B2 | | 2/2004 | Furner | |
| 6,722,169 | B2 | | 4/2004 | Segawa | |
| 6,733,049 | B2 | * | 5/2004 | Piorkowski et al. | 292/139 |
| 7,269,984 | B2 | * | 9/2007 | Jackson | 70/210 |
| 7,603,881 | B2 | * | 10/2009 | Yukihara et al. | 70/208 |
| 2004/0182120 | A1 | * | 9/2004 | Flory et al. | 70/134 |
| 2006/0150693 | A1 | | 7/2006 | Houlihan et al. | |
| 2008/0134735 | A1 | | 6/2008 | Gallo et al. | |

FOREIGN PATENT DOCUMENTS

| | | | |
|---|---|---|---|
| DE | 3437563 | A1 | 4/1986 |
| DE | 10 2005 034 833 | | 2/2006 |
| EP | 1617024 | | 5/2005 |
| GB | 1278129 | | 6/1972 |
| JP | 2001-271547 | | 5/2001 |

OTHER PUBLICATIONS

International Search Report and Written Opinion from PCT/US07/03548 mailed Jan. 9, 2008, 12 pages.

Correspondence dated Mar. 21, 2011 from Cantoer Colburn, LLP firm, 2 pgs.

Apr. 29, 2011, Correspondence from Christopher C. Boehm to David Grover.

Apr. 8, 2011, Correspondence from David Grover to Chris Boehm.

Apr. 1, 2011, Correspondence from Christopher C. Boehm to David Grover.

Mar. 28, 2011, Correspondence from David Grover to Christopher C. Boehm.

* cited by examiner

LOCKER LOCK

CROSS REFERENCE TO RELATED APPLICATION

This application claims the benefit of U.S. Patent Application Ser. No. 60/904,243, entitled "LOCKER LOCK" and filed Mar. 1, 2007, the entire contents of which are incorporated herein by reference, to the extent that they are not conflicting with the present application.

BACKGROUND OF THE INVENTION

Conventional locker locks employ a locking bolt that interferes with a frame member of the locker to prevent the locker door from being opened. When the locker lock is unlocked, for example, by turning a dial or dials to an authorized position or sequence of positions, or by insertion and rotation of a proper key, the locking bolt is disengaged or withdrawn from the locker frame member, allowing the locker door to be opened. The locker lock may, for example, utilize a horizontally moving locking bolt, which may be retracted into a lock body and out of engagement with the frame member when the lock is unlocked.

The conventional retractable locking bolt for a "single point" locker lock (named for the single point of locking engagement between the locking bolt and the locker frame) is typically spring biased into an extended position and is not secured or locked in this extended position, and therefore may potentially be pushed into the lock without proper operation of the locking mechanism (e.g., by dialing an authorized combination, or by using a proper key). As a result, the locker may be susceptible to unauthorized entry, for example, by bumping, jamming, or jimmying the locking bolt into the lock and out of engagement with the locker frame. While the use of additional locking bolts (a "multiple point" locker lock) may improve locker security, such an arrangement may be both complex and more expensive in institutional settings, such as a school.

SUMMARY OF THE DISCLOSURE

The present application describes locking arrangements which may be provided for securing a first structure (such as a locker door) to a second structure (such as a locker enclosure), in which a locking member is secured (or dead-locked) ill a locking condition, thereby impeding unauthorized retraction or disengagement of the locking member from a frame member of the second structure. According to an inventive aspect of the present application, the locking member may rotate between locking and releasing positions (as compared to, for example, a sliding locking member) to deter tampering with the locking member. According to another inventive aspect, a slidable locking bolt may be utilized to secure a rotary locking member in a locking position.

Accordingly, in one embodiment, a lock includes a lock interface, a rotary locking member, a locking bolt, and a locking mechanism. The rotary locking member extends from a side portion of the lock housing, the rotary locking member being rotatable about a first axis between a locking position and a releasing position. The locking bolt is configured to hold the rotary locking element in the locking position when the locking bolt is in a first position and to allow the rotary locking member to rotate from the locking position to the releasing position when the locking bolt is in a second position. The locking mechanism is configured to slide the locking bolt from the first position to the second position in response to proper manipulation of the lock interface.

BRIEF DESCRIPTION OF THE DRAWINGS

Features and advantages of the invention will become apparent from the following detailed description made with reference to the accompanying drawings, wherein.

DETAILED DESCRIPTION

Figure 1A:
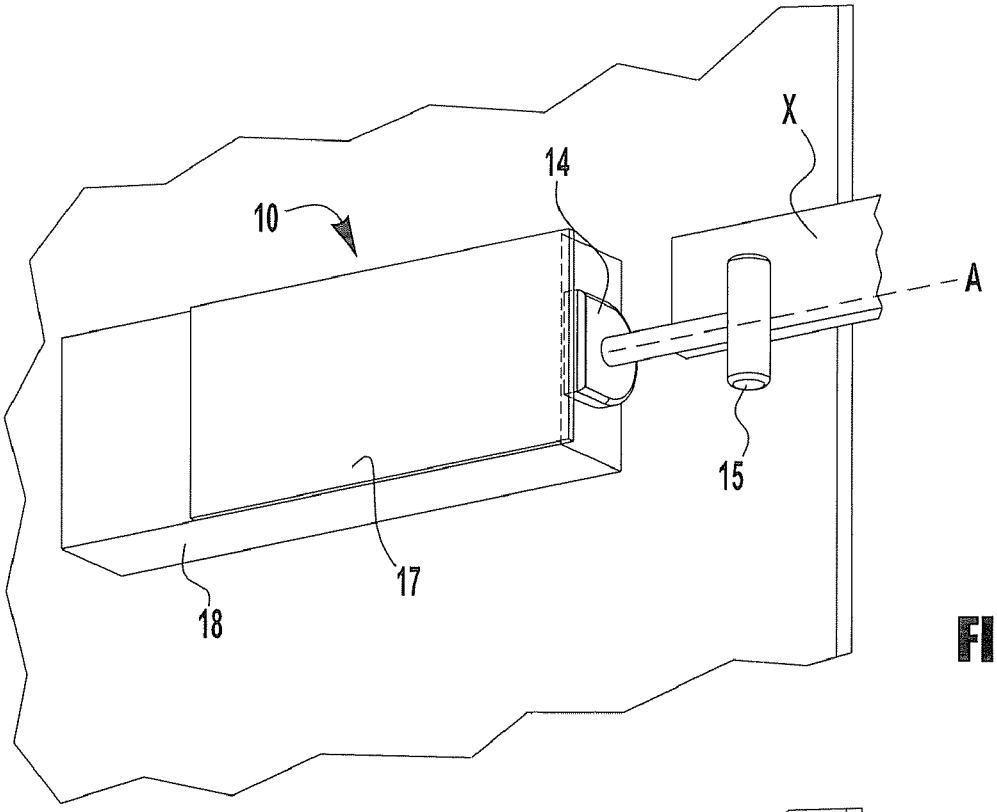
FIG. 1A illustrates a schematic view of a single point locker lock in a locked condition.

This Detailed Description of the Invention merely describes embodiments of the invention and is not intended to limit the scope of the claims in any way. Indeed, the invention as described is broader than and unlimited by the preferred embodiments, and the terms used have their full ordinary meaning. For example, while the embodiments described herein relate to locking arrangements for a combination locker lock, the inventive features may be utilized in many different types of locks for doors, containers, or other such structures, and with many different types of locking interfaces, including, for example, key operated, single dial combination, and multiple dial combination locking interfaces.

The present application contemplates a locking arrangement that is configured to impede or prevent movement of a first structure (such as a locker door) out of locking engagement with a second structure (such as a locker frame) when the locking arrangement is in a locked condition. While many different locking arrangements may be used to secure the locking member in the locked condition, according to one inventive aspect of the present application, a locker lock includes a locking member that rotates from a frame member engaging or blocking position to a frame member disengaging or releasing position when the locking arrangement is moved from a locked condition to an unlocked condition. By using a rotating or rotary locking member to selectively retain a frame member of a structure to be locked, unauthorized tampering (such as, for example, forced retraction of a sliding locking member, common in conventional locker locks) may be inhibited. Tampering with the locking member may further be inhibited by configuring the locking arrangement such that rotation of the locking member is prevented when the locking arrangement is in the locked condition, thereby providing a dead-locked condition, in which obstructed access to the locking member by the user (for example, by a locker door) is not relied on to prevent unauthorized access. When the locking arrangement is moved to the unlocked condition, the locking member is permitted to rotate, for example, by a spring loaded mechanism or by manual operation by the user, out of blocking engagement with the locker frame, allowing the locker door to be opened.

The present application also contemplates a locker lock configured to engage and disengage from a locker frame member through movement in a vertical direction with respect to the frame member. In some applications, a lockable structure, such as a storage locker, may be more easily manufactured with more exacting vertical dimensional tolerances than with more exacting horizontal dimensional tolerances. By providing a lock with a locking member that moves vertically with respect to a frame member for vertical disengagement from and engagement with the frame member, the lockable structure may be made more efficiently. While a locking member may be vertically slidable for disengagement from and engagement with the frame member, in another embodiment, as illustrated in the present application, a locking member may be pivotable or rotatable to vertically engage with and disengage from the frame member.

While the specification and drawings of the present application describe locker embodiments in which a lock is assembled with a locker door for locking engagement with the locker enclosure or frame, these same inventive features may be applied to a locker arrangement in which a lock is assembled with a locker frame or enclosure for locking engagement with the locker door.

Figure 1B:
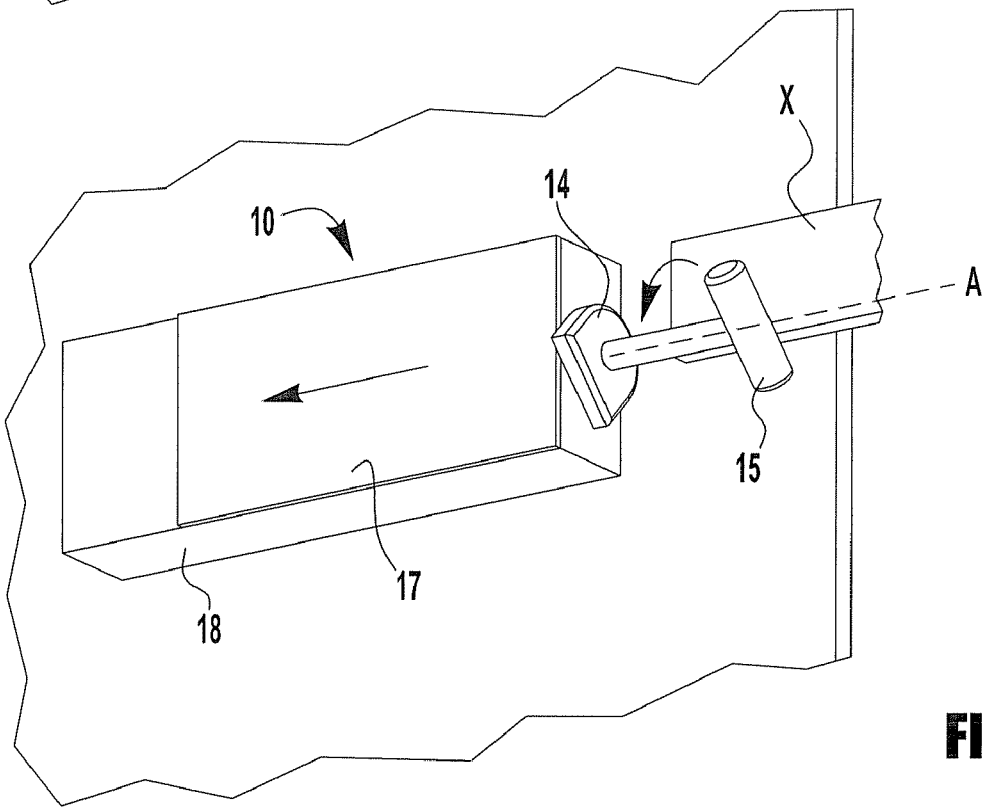
FIG. 1B illustrates a schematic view of the single point locker lock of FIG. 1A in an unlocked condition.

FIGS. 1A and 1B illustrate an exemplary locking arrangement 10 with a rotary locking member or catch (shown schematically at 15) that rotates about axis A from an obstructing or locking position (shown in FIG. 1A) to a unlocking or releasing position (shown in FIG. 1B) when the locking mechanism (shown schematically at 18) is moved from a locked condition (FIG. 1A) to an unlocked condition (FIG. 1B). In the exemplary embodiment, the rotary locking member 15 includes a shaft portion 14 that is held in the obstructing position by a locking bolt 17, which may be partially or fully enclosed within a lock housing (such as, for example, the lock housing 121 of FIGS. 4A-4C), to prevent tampering with the locking bolt 17. While a lock housing may fully enclose (when assembled with a locker door) one or more of the internal lock components, a lock housing, as used in this specification, may comprise a wall, plate, flange, or other such barrier (not shown) for supporting or retaining one or more of the internal lock components, such as the locking bolt.

When the locking mechanism 18 is moved to the unlocked condition, as shown in FIG. 1B, the locking bolt 17 is moved out of engagement with a bolt engaging portion of the rotary locking member (flatted portion of shaft 14), allowing the rotary locking member 15 to rotate and disengage from the frame member X, thereby allowing the locker door (not shown) to be opened. As used herein, a frame member may include any component connected with the locker that may be sized and positioned to engage the rotary locking member 15, such as, for example, a portion of the locker enclosure or a plate affixed to the locker.

While many different types of locking bolt movement may be used to selectively permit rotational movement of the rotary locking member 15, including, for example, rotating, pivoting, and axial or lateral sliding movement, in the illustrated embodiment, the locking bolt is configured to slide in a direction parallel to the rotary locking member axis A, providing for a relatively compact locking arrangement.

Figure 2A:
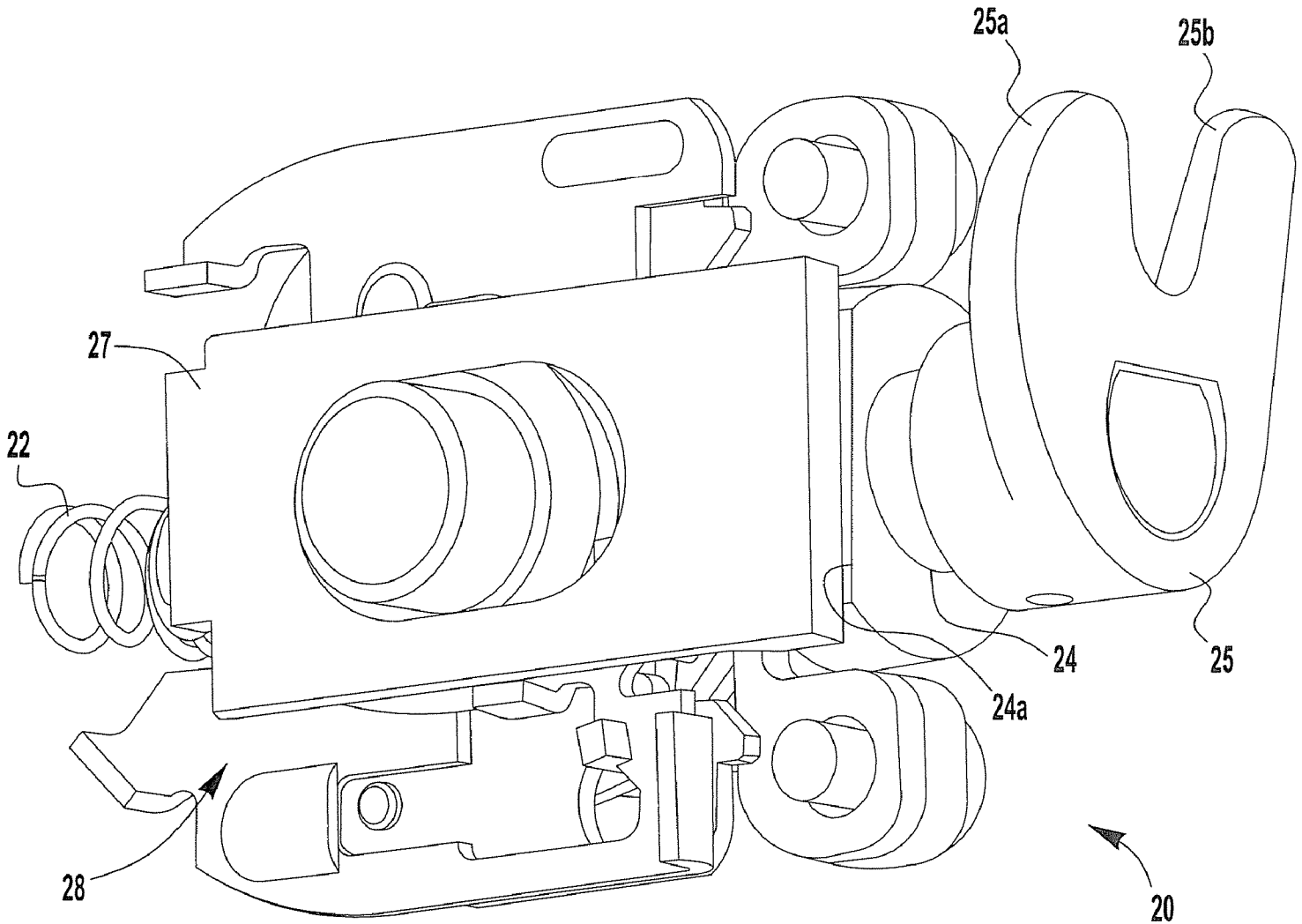
FIG. 2A illustrates a rear perspective view of a single point locking arrangement for a locker lock, shown in the locked condition.
Figure 2B:
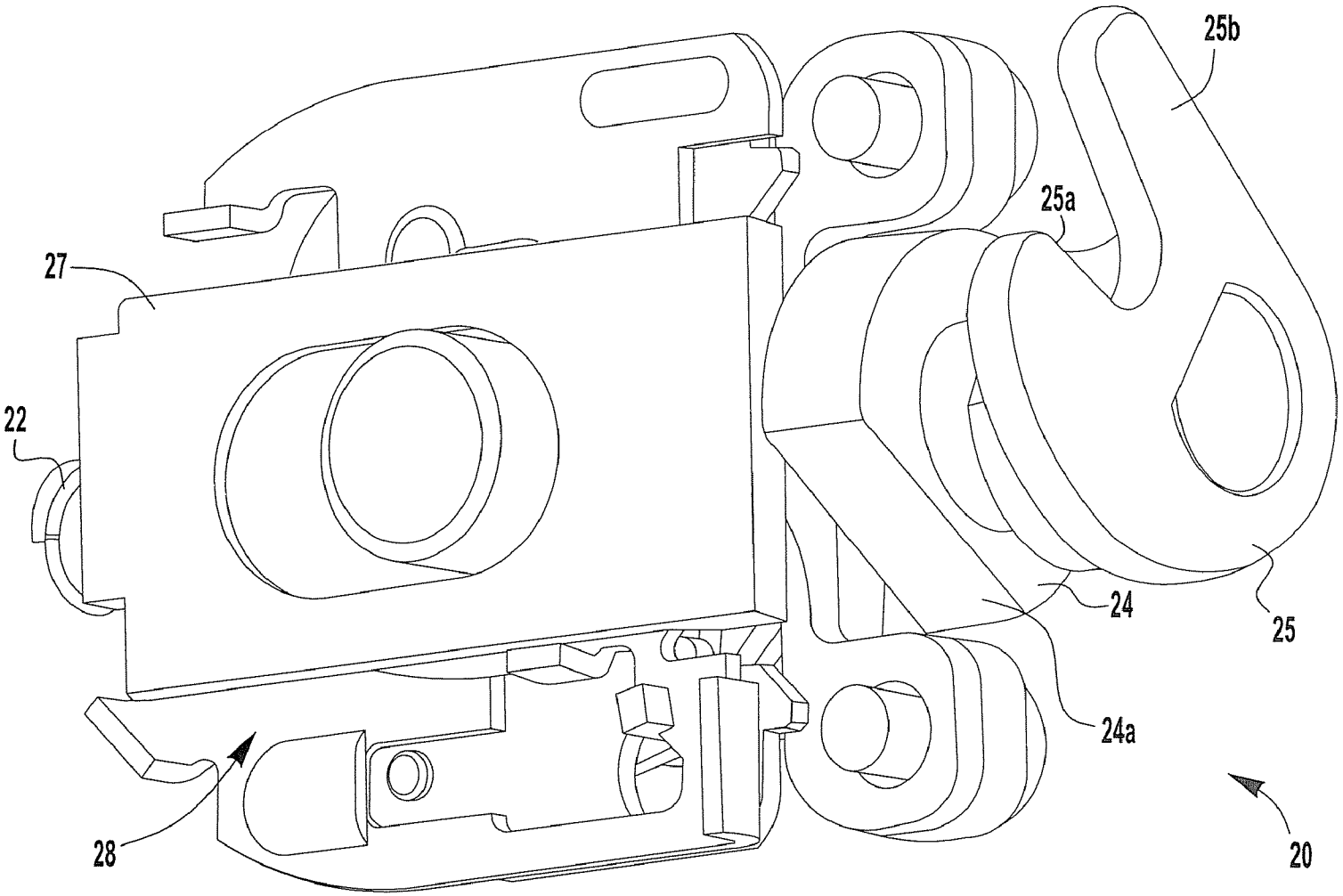
FIG. 2B illustrates a rear perspective view of the locking arrangement of FIG. 2A, shown in the unlocked condition.
Figure 2C:
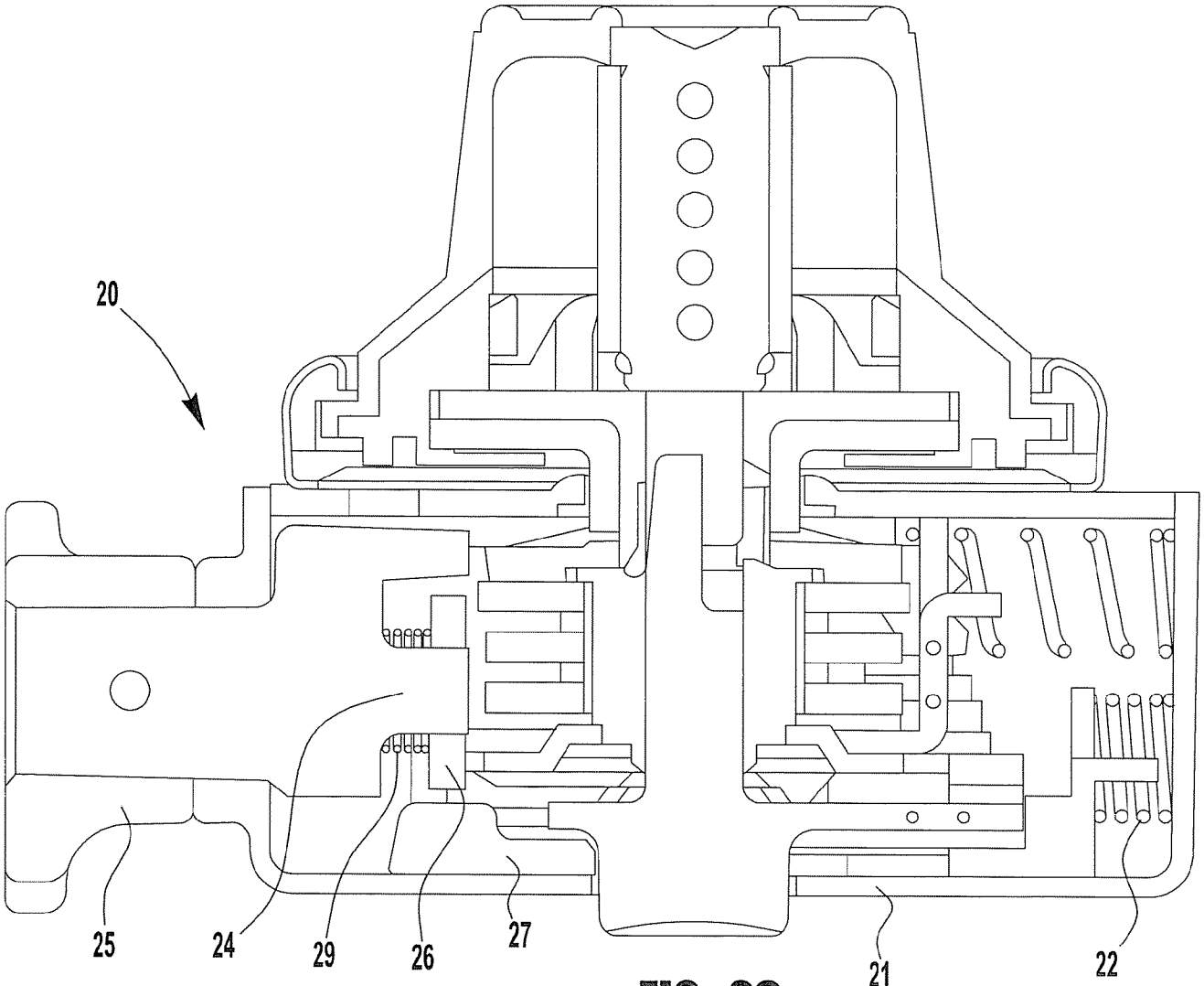
FIG. 2C illustrates a bottom cross-sectional view of the locking arrangement of FIG. 2A, including a lock housing.

The schematically illustrated locking arrangement 10 of FIGS. 1A and 1B may include many different types and combinations of configurations. FIGS. 2A and 2B illustrate one such exemplary locking arrangement 20. While many configurations may be used to engage the locking bolt 27 with the rotary locking member 25 to hold the locking member 25 in locking engagement with a locker frame member X, in the illustrated embodiment, the locking bolt 27 aligns with a complementary shaped flat portion 24*a* of the shaft 24 when the locking bolt is in a first position (for example, in an extended position). In other embodiments (not shown), other complementary shaped surfaces may be used on the locking bolt and shaft to prevent rotation of the shaft when the complementary shaped surfaces are in engagement with each other, including, for example, notched, stepped or curved surfaces. This secure engagement between the locking bolt 27 and the rotary locking member 25 prevents unauthorized manipulation of the rotary locking member 25 by insertion of a lock pick or other tool through a seam between the locker door and the locker enclosure. Since the locking bolt 27 must be retracted to allow for rotation of the locking member, unauthorized manipulation of the lock may further be impeded by fully enclosing the locking bolt 27 within a lock housing 21 (see FIG. 2C), thereby preventing access to the locking bolt 27 from outside the locker door.

Figures 3B, 3C, 3D, 3E, 3F, 3G:
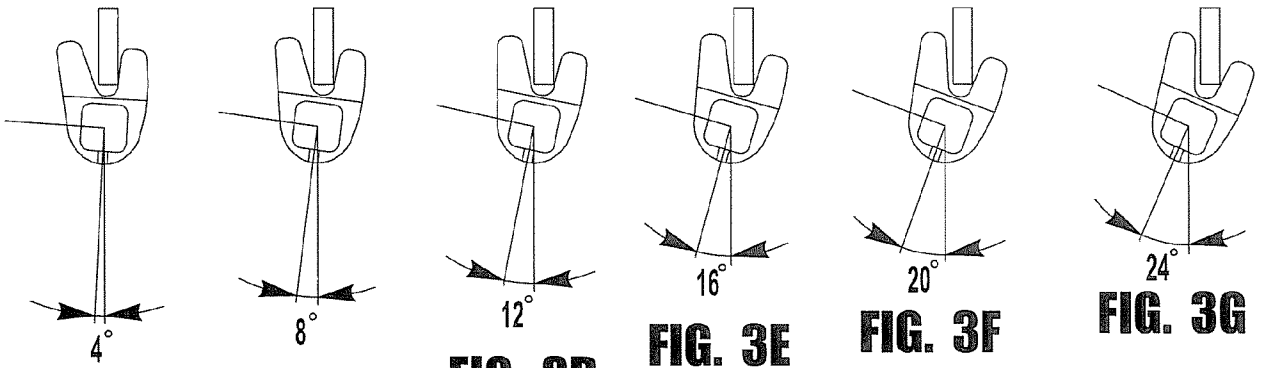
FIGS. 3A-3N illustrate sequential side views of a locking clasp for a locker lock, showing rotation of the locking clasp from a locked condition to an unlocked condition.
Figure 3A:
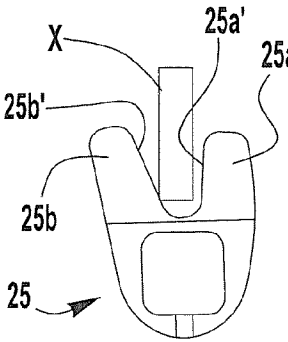
Figures 3H, 3I, 3J, 3K, 3L, 3M, 3N:
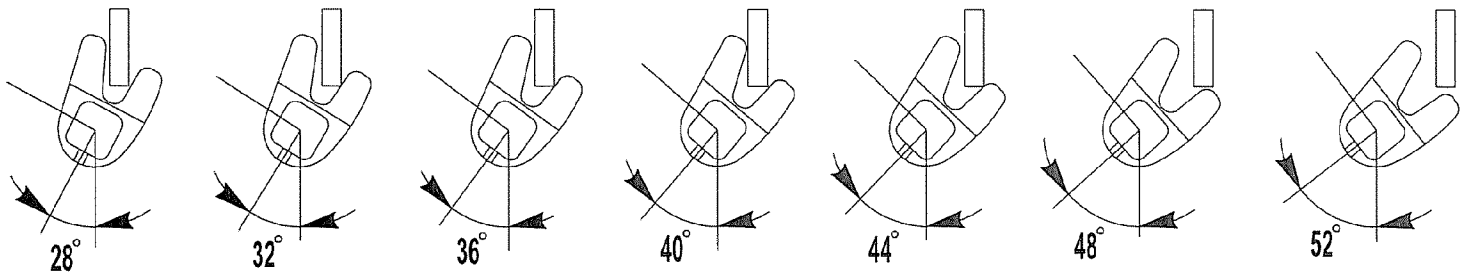

As shown in FIG. 2B, when the locking mechanism 28 is moved to the unlocked condition, the locking bolt 27 is retracted against a bolt biasing member or spring 22 and out of engagement with the flat portion 24*a*, allowing the shaft 24 and locking member 25 to rotate, disengaging the locking member 25 from the frame member X (see FIGS. 3A-3N). In this releasing position, the shaft portion 24 of the rotary locking member 25 may be positioned to hold the locking bolt 27 in the second or retracted position, for example, against the bolt biasing member 22. In one exemplary embodiment, as illustrated in the cross-sectional view of FIG. 2C, the rotary locking member 25 is biased toward the releasing or disengaging position by a rotary biasing member or torsion spring 29 assembled with the shaft 24 and a shaft support 26 (more clearly shown at 126 in FIG. 4C), upon which the shaft 24 is rotatably mounted.

While providing a locker lock with a fully enclosed sliding locking bolt may prevent unauthorized access to a locker, for example, by insertion of lock picking tools through a seam or opening in the locker door, in some applications, it may be desirable to provide access to the locking bolt from outside the lock housing and from an inner side of the locker door. For example, where a lock on an unlocked door has been inadvertently returned to the locked condition, it may be inconvenient to have to dial the authorized lock combination to release the locking member in order to close the locker door. By providing a lock with operable access to the locking bolt, the lock of the opened locker may be returned to an unlocked condition without having to dial the combination. As another example, where a person has been closed inside a locker, operable access to the locking bolt from inside the locker may be a useful safety feature, allowing the trapped individual to release himself.

Figure 2D:
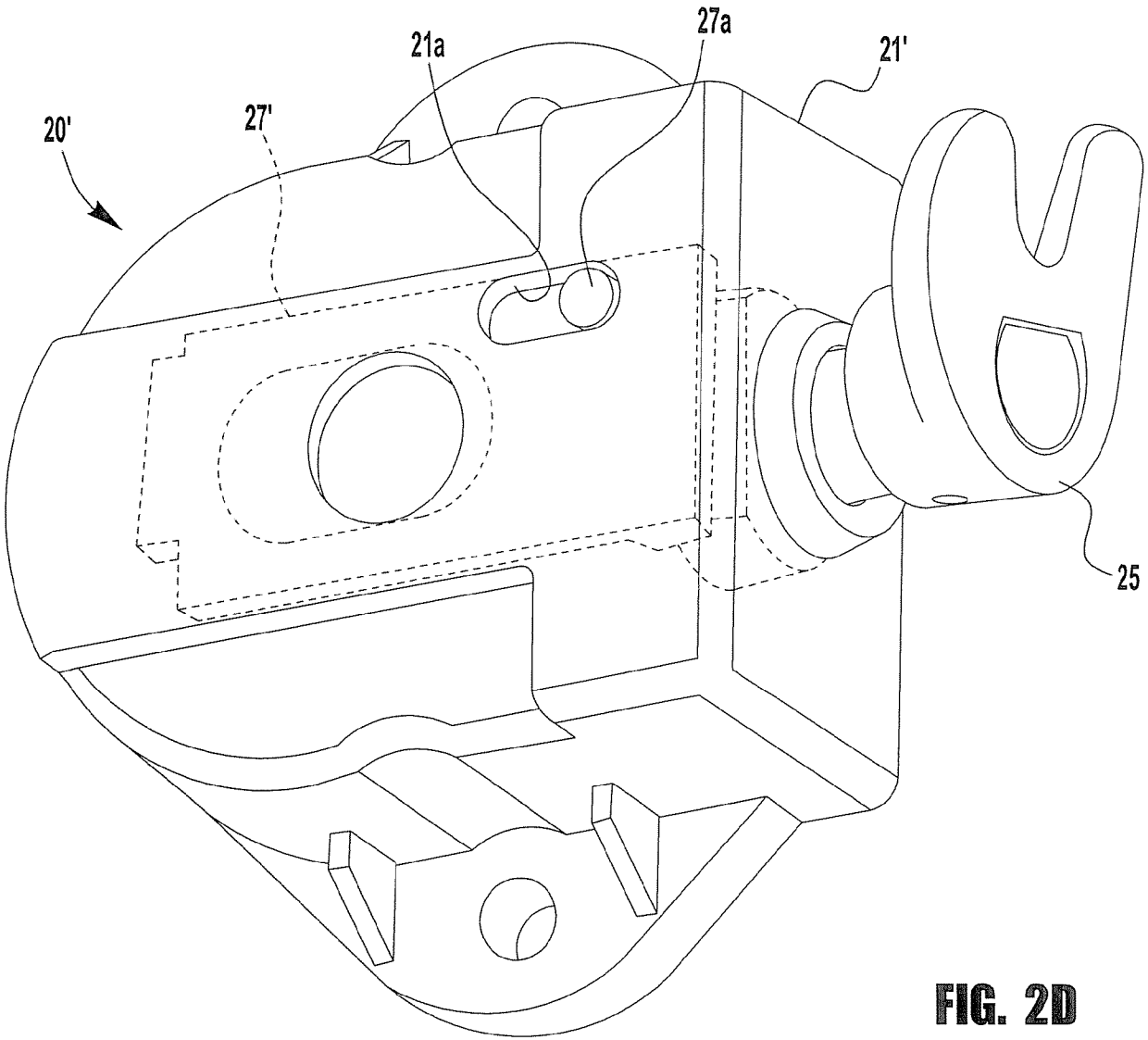
FIG. 2D illustrates a rear perspective view of another locking arrangement for a locker lock.

While many different configurations may be utilized to provide operable access to the locking bolt from inside the locker door, in one embodiment, a projection may extend from the locking bolt through an opening in the lock housing, the projection being accessible from outside the housing to slide the locking bolt from the locked or extended position to the unlocked or retracted position. FIG. 2D illustrates an exemplary embodiment of a lock 20' having a nub 27*a* extending from the locking bolt 27' through a slot 21*a* in the lock housing 21'. To unlock the lock 20' from inside the locker door (not shown), a user slides the nub 27*a* along the slot 21*a*, thereby retracting the locking bolt 27' and disengaging the locking bolt 27' from the rotary locking member 25. The spring-loaded locking member 25 may then rotate to the releasing position. To deter access to this override or unlocking feature from outside the locker door, access to the nub 27*a* may be limited, for example, by limiting the amount the nub 27*a* extends out of the housing 21', by partially enclosing or surrounding the nub (not shown), or by requiring that the nub 27*a* be pulled, depressed, or otherwise manipulated before the nub is able to slide along the slot 21*a*. While the slot 21*a* is shown on the rear side of the lock housing 21', a slot may alternatively be provided on another side of the lock housing (not shown).

The rotary locking member 25 may be provided in many different shapes and orientations. According to an inventive aspect of the present application, a rotary locking member may include a frame obstructing portion configured to block movement of the locker door with respect to the locker frame, and a lock resetting portion configured to engage a locker frame member as the locker door is closed, causing the rotary locking member to be rotated back to the locking position when the door is closed. These portions may be joined to form an arcuate, U-shaped, or two-pronged locking member configured to retain a frame member between the two portions when the locker door is closed. As illustrated, for example, in FIGS. 2A and 2B, the exemplary locking member 25 includes a frame obstructing portion or first prong 25*a*, which blocks movement of the lock 20 and the locker door with respect to the locker frame to prevent the locker door from opening. The locking member 25 also includes a lock resetting portion or second prong 25*b*, which engages a frame member when the locker door is returned to the closed position, thereby returning the locking member 25 back to the obstructing or locking position. In other embodiments (not shown), the shaft 24 and locking member 25 may be returned to a locking or obstructing position by some other suitable mechanism.

As shown most clearly in FIGS. 3A-3N, the obstructing and shaft resetting portions 25*a*, 25*b* may be joined to form a forked or generally U-shaped member, which may be specially contoured or adapted, for example, to provide more secure obstruction of the frame member X (by providing a steeper angled internal edge 25*a*' on the obstructing portion 25*a*), to facilitate release of the frame member X during rotation (by providing a shorter obstructing portion 25*a* and a shallower angled internal edge 25*b*' on the shaft resetting portion 25*b*), or to facilitate return of the locking member 25 to the obstructing position when the locker door is closed (by providing a longer shaft resetting portion 25*b*). The specific shape of the locking member, and the relation in shape, size, and orientation between first prong 25*a* and second prong 25*b* is shown for exemplary purposes only. It should be apparent to others with ordinary skill in the art that the shape, size, and orientation of these portions may vary in the practice of this invention.

As shown in FIGS. 3A-3N, as the locking member 25 is rotated, the locking member 25 (and with it, the rest of the locking arrangement) is permitted to move slightly outward with respect to the frame member X in a door opening direction until the locking member 25 is disengaged from the frame member X (see FIGS. 3M and 3N) and the locker door may be fully opened. While the illustrated embodiment is configured to release the locking member 25 from the frame member X after approximately 45°-50° rotation of the locking member 25 and shaft 24, a locking arrangement may be configured to release a locking member from a frame member responsive to other amounts of rotation by a corresponding shaft.

When the locker door of a locker using the illustrated locking arrangement 20 is moved back to a closed condition, the locking member 25 and the shaft 24 of the illustrated embodiment are rotated back to the locking position (shown, for example, in FIG. 2A), which aligns the flat portion 24*a* of the shaft 24 with the locking bolt 27, allowing the spring biased locking bolt 27 to extend, thereby resecuring the rotary locking member in the locking position.

Figure 4A:
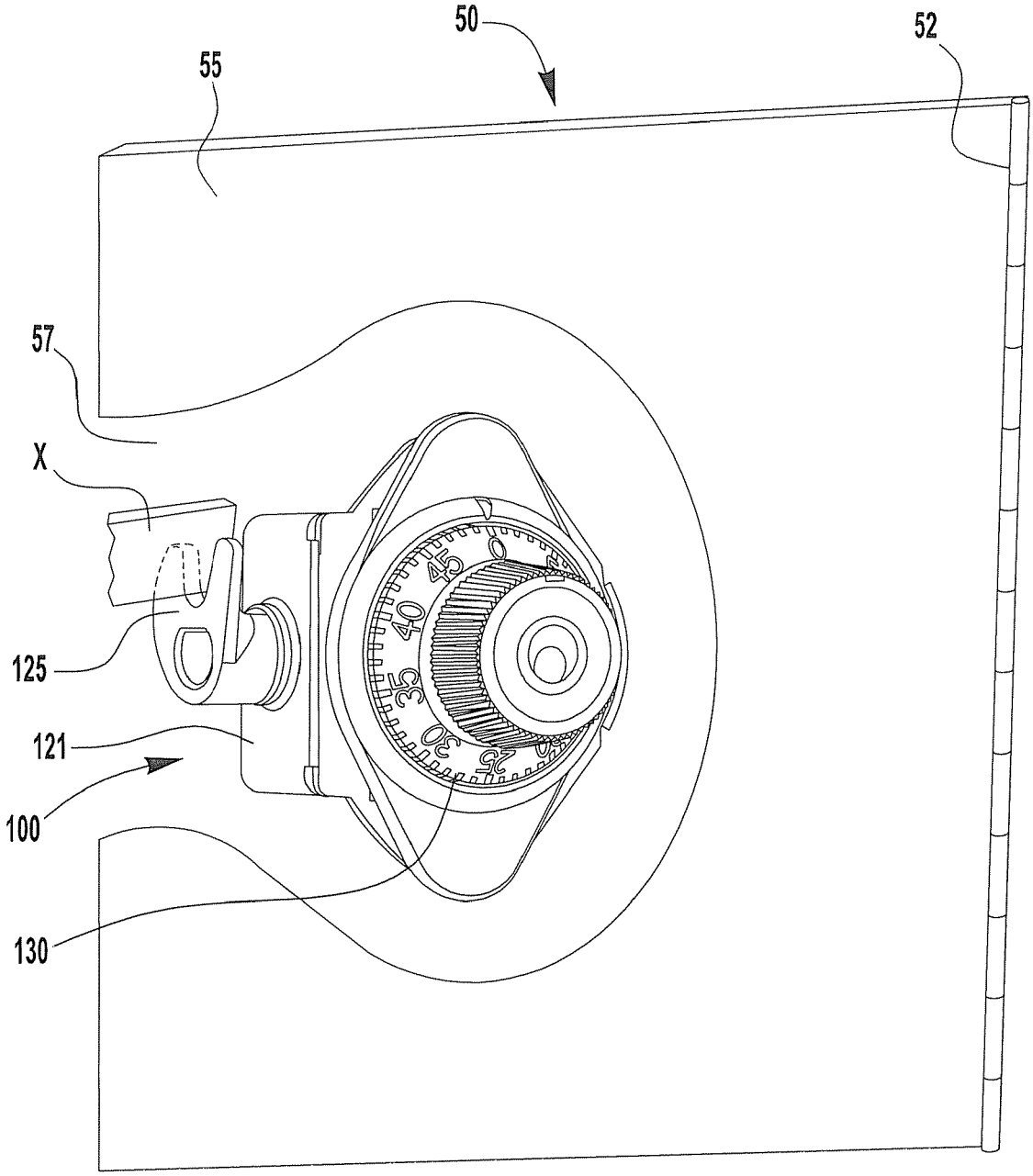
FIG. 4A illustrates a front perspective view of a locker assembly including a combination lock, with a portion of the locker door removed to illustrate additional features of the combination lock.
Figure 4B:
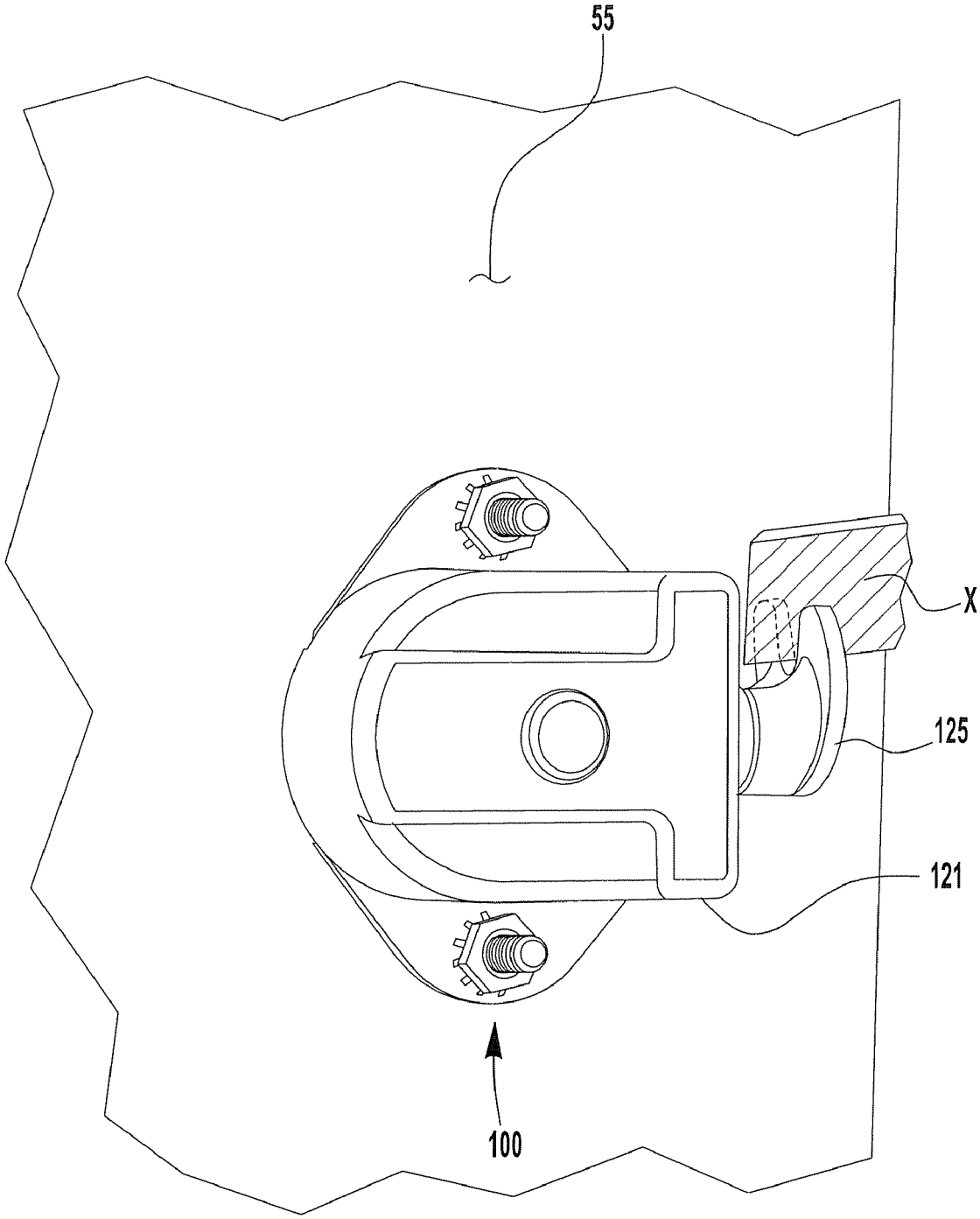
FIG. 4B illustrates a rear perspective view of the locker assembly of FIG. 4A.
Figure 4C:
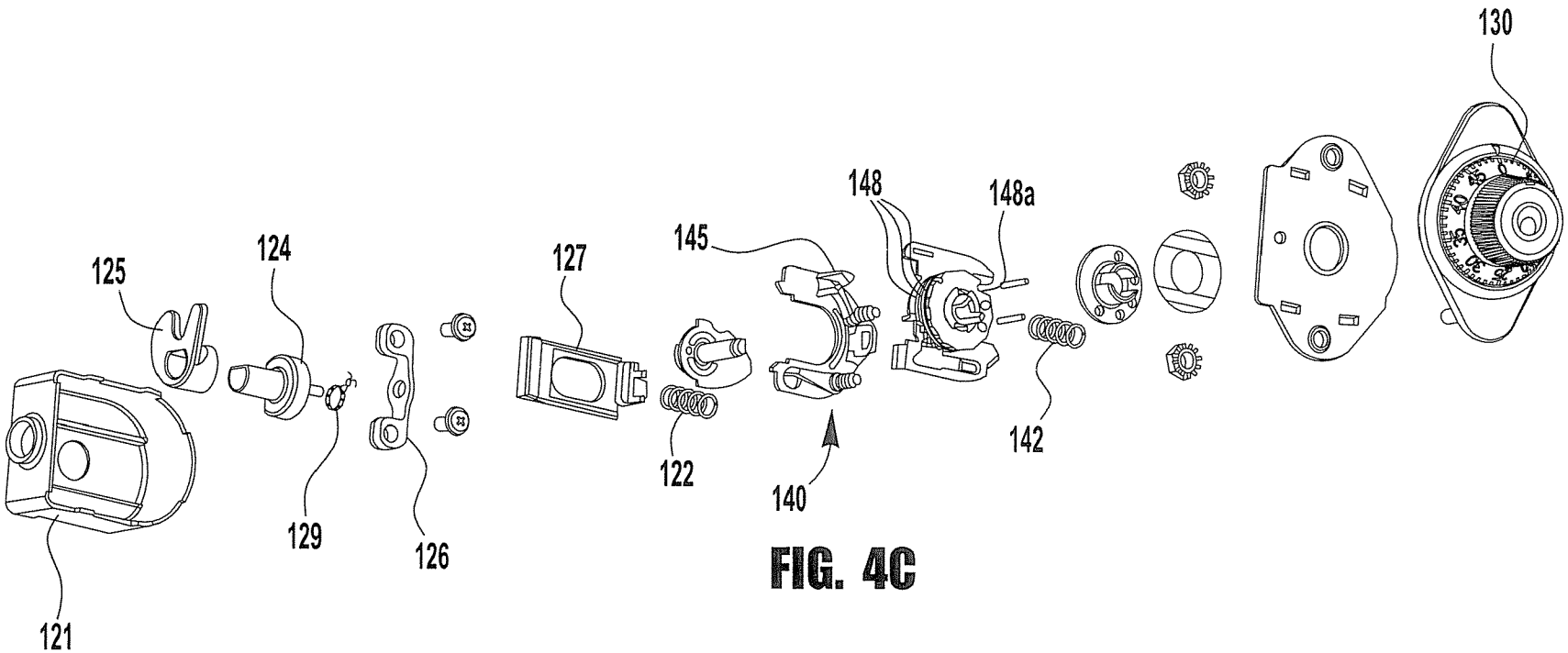
FIG. 4C illustrates an exploded perspective view of the combination lock of the locker assembly of FIG. 4A.

The inventive features of the locking arrangement described herein may be applied to many different types of locks, including, for example, key operated locker locks and combination locker locks. FIGS. 4A-4C illustrate an exemplary combination lock arrangement 100 for a locker 50 having a locker enclosure 57 with frame member X at a first side of the enclosure 57, and a locker door 55 hingedly mounted (at hinged portion 52) to a second side of the locker enclosure 57. While many different lock interfaces may be employed, the illustrated embodiment includes a single dial combination lock interface 130 disposed on an exterior side of the locker door 55.

While many different locking mechanisms may be used to move a locking bolt to allow rotation of a shaft and locking member, in the illustrated embodiment, as shown in the exploded view of FIG. 4C, a locking mechanism may include a spring loaded lever assembly 140, wherein a spring-biased lever 145 engages a series of cams 148 when the cams are oriented to align corresponding notches 148*a* (by proper incremental rotation of the combination dial 130). The resulting movement of the lever 145 causes the lever assembly 140 and connected locking bolt 127 to retract against springs 142, 122. When the cams 148 are rotated out of this alignment, the springs 142, 122 bias or force the lever assembly 140 and locking bolt 127 back outward, such that when the shaft 124 is rotated against spring 129 to an orientation allowing extension of the locking bolt 127, the locking bolt 127 will extend to secure the shaft 124 (and with it the rotary locking member 125) in this obstructing orientation. A similar locking mechanism is described in co-pending U.S. Patent Application Publication No. 2004-0182120, entitled "Locker Lock" and filed Oct. 17, 2003, the entire disclosure of which is incorporated by reference herein, to the extent that it is not conflicting with the present application.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A locker lock comprising:

a lock housing for assembly with a locker;

a lock interface disposed on an external surface of the housing;

a rotary locking mechanism partially received within the lock housing and rotatable about a first axis between a locked position and a release position, the rotary locking mechanism being biased toward the release position by a rotary biasing member;

a locking bolt biased toward a first position by a bolt biasing member, the locking bolt including a retaining portion that engages a bolt interlocking portion of the rotary locking mechanism to hold the rotary locking mechanism in the locked position when the locking bolt is in the first position; and a locking mechanism configured to move the locking bolt against the bolt biasing member and in a direction parallel to the first axis from the first position to a second position in response to proper manipulation of the lock interface;

wherein movement of the locking bolt to the second position allows the rotary locking mechanism to rotate from the locked position to the release position, the rotary locking mechanism including a bolt blocking portion configured to hold the locking bolt in the second position when the rotary locking mechanism is in the release position; and further wherein the entirety of the locking bolt, the bolt interlocking portion, and the bolt blocking portion of the rotary locking mechanism are disposed entirely within the lock housing when the locking bolt is in the first and second positions.

2. The locker lock of claim 1, wherein the lock interface comprises a combination dial.

3. The locker lock of claim 1, wherein the lock interface comprises a key operated lock interface.

4. The locker lock of claim 1, wherein the rotary locking mechanism comprises first and second prong portions configured to retain a locker frame member therebetween when the rotary locking mechanism is in the locked position.

5. The locker lock of claim 1, wherein the locking bolt is disposed entirely within the lock housing when the locking bolt is in the first position and when the locking bolt is in the second position.

6. The locker lock of claim 5, wherein the locking bolt remains disposed entirely within the lock housing as the locking bolt is moved between the first position and the second position.

7. The locker lock of claim 1, wherein the rotary locking mechanism comprises a rotary locking member and a shaft extending from the rotary locking member, the rotary locking mechanism being pivotable about an axis defined by the shaft.

8. The locker lock of claim 7, wherein the bolt interlocking portion is disposed on the shaft.

9. The locker lock of claim 1, wherein the bolt biasing member is disposed between the housing and a rearmost surface of the locking bolt distal to the rotary locking mechanism to bias the rearmost surface of the locking bolt toward the rotary locking mechanism.

10. The locker lock of claim 1, wherein the lock interface is disposed on a front surface of the housing, and wherein rotation of the locking mechanism about a second axis perpendicular to the front surface of the housing moves the locking bolt against the bolt biasing member.

11. A locker assembly comprising:

a locker enclosure having an external wall defining a locker opening and a frame member extending into the locker opening from a first side of the enclosure;

a locker door hingedly mounted to the locker enclosure at a second side of the enclosure opposite the first side for pivoting between an open position and a closed position; and a lock assembled with the locker door, the lock comprising:

a lock housing;

a lock interface disposed on the lock housing;

a rotary locking member rotatable about a first axis between a locked position and a release position, the rotary locking member being configured to engage the frame member when the locker door is in the closed position and the rotary locking member is in the locked position;

a rotary biasing member configured to bias the rotary locking member toward the release position;

a locking bolt configured to hold the rotary locking member in the locked position when the locking bolt is in a first position and to allow the rotary locking member to rotate from the locked position to the release position when the locking bolt is in a second position, the locking bolt being disposed entirely within the lock housing when the locking bolt is in the first position and when the locking bolt is in the second position; and a locking mechanism configured to slide the locking bolt from the first position to the second position in response to proper manipulation of the lock interface;

wherein when the locker door is pivoted from the open position to the closed position, the frame member rotates the rotary locking member from the release position to the locked position.

12. The locker assembly of claim 11, wherein the rotary locking member comprises first and second prong portions configured to retain the frame member therebetween when the rotary locking member is in the locked position.

13. The locker assembly of claim 11, wherein the lock interface comprises a combination dial.

14. The locker assembly of claim 11, wherein the lock interface comprises a key operated lock interface.

15. The locker assembly of claim 11, wherein the locking bolt is configured to slide in a direction parallel to the first axis.

16. The locker assembly of claim 11 wherein both the locking bolt and the rotary locking member are disposed entirely inward of the locker door.

17. The locker assembly of claim 11, wherein the lock further comprises a bolt biasing member configured to bias the locking bolt toward the first position.

18. The locker assembly of claim 17, wherein the rotary locking member is configured to hold the locking bolt in the second position against the bolt biasing member when the rotary locking member is in the release position.

19. The locker assembly of claim 11, wherein the locking bolt includes a retaining portion that engages a bolt interlocking portion of a shaft extending from the rotary locking member to hold the rotary locking member in the locked position when the locking bolt is in the first position, the retaining portion of the locking bolt and said portion of the rotary locking member being disposed entirely within the lock housing.

20. The locker assembly of claim 11, wherein the locking bolt remains disposed entirely within the lock housing as the locking bolt is moved between the first position and the second position.

21. A locker lock comprising:

a lock housing for assembly with a locker door;

a lock interface disposed on a front portion of the lock housing;

a rotary locking mechanism including a rotary locking member at least partially received in the lock housing and extending from a side portion of the lock housing, and a shaft extending from the rotary locking member, the shaft being retained within the lock housing, the rotary locking mechanism being rotatable about an axis defined by the shaft between a locked position and a release position;

a locking bolt including a retaining portion that engages a portion of the rotary locking mechanism to hold the rotary locking mechanism in the locked position when the locking bolt is in a first position, the retaining portion disengaging from said bolt interlocking portion when the locking bolt is in a second position to allow the rotary locking mechanism to rotate from the locked position to the release position, the locking bolt being disposed entirely within the lock housing when the locking bolt is in the first position and when the locking bolt is in the second position; and a locking mechanism configured to slide the locking bolt from the first position to the second position in response to proper manipulation of the lock interface;

wherein the retaining portion of the locking bolt and said bolt interlocking portion of the rotary locking mechanism are disposed entirely within the lock housing; and further wherein at least a portion of the shaft overlaps with the locking bolt when the locking bolt is in the second position.

22. The locker lock of claim 21, wherein the lock interface comprises a combination dial.

23. The locker lock of claim 21, wherein the lock interface comprises a key operated lock interface.

24. The locker lock of claim 21, wherein said bolt interlocking portion comprises a flatted portion of the shaft.

25. The locker lock of claim 21, wherein a bolt blocking portion of the rotary locking member is configured to prevent engagement of the locking bolt with said bolt interlocking portion when the rotary locking mechanism is in the release position.

26. The locker assembly of claim 21, wherein the rotary locking mechanism comprises first and second prong portions configured to retain a locker frame member therebetween when the rotary locking mechanism is in the locked position.

27. The locker assembly of claim 21, wherein the locking bolt is configured to slide in a direction parallel to the shaft.

28. The locker assembly of claim 21, further comprising a bolt biasing member configured to bias the locking bolt toward the first position.

29. The locker assembly of claim 28, wherein the rotary locking mechanism is configured to hold the locking bolt in the second position against the bolt biasing member when the rotary locking mechanism is in the release position.

30. The locker lock of claim 21, wherein the bolt interlocking portion is disposed on the shaft.

31. A locker lock comprising:

a unitary lock housing for assembly with a locker;

a combination dial disposed on an external surface of the housing;

a rotary locking mechanism pivotally secured to the lock housing, partially received within the lock housing, and rotatable about a first axis between a locked position and a release position, the rotary locking mechanism being biased toward the release position by a rotary biasing member, wherein the rotary locking mechanism comprises first and second prong portions configured to retain a locker frame member therebetween when the rotary locking mechanism is in the locked position;

a locking bolt biased toward a first position by a bolt biasing member, the locking bolt including a retaining portion that engages a bolt interlocking portion of the rotary locking mechanism to hold the rotary locking mechanism in the locked position when the locking bolt is in the first position, the locking bolt being in direct contact with the unitary lock housing and being disposed entirely within the lock housing when the locking bolt is in the first position and when the locking bolt is in a second position; and a locking mechanism configured to move the locking bolt against the bolt biasing member and in a direction parallel to the first axis from the first position to the second position in response to proper manipulation of the combination dial;

wherein movement of the locking bolt to the second position allows the rotary locking mechanism to rotate from the locked position to the release position, the rotary locking mechanism being configured to hold the locking bolt in the second position when the rotary locking mechanism is in the release position.

32. The locker lock of claim 31, wherein the locking bolt remains disposed entirely within the lock housing as the locking bolt is moved between the first position and the second position.

33. The locker lock of claim 31, wherein the rotary locking mechanism comprises a rotary locking member and a shaft extending from the rotary locking member, the rotary locking mechanism being pivotable about an axis defined by the shaft.

34. The locker lock of claim 33, wherein the bolt interlocking portion is disposed on the shaft.

* * * * *